United States Patent [19]

Kubiak

[11] Patent Number: 4,779,437

[45] Date of Patent: Oct. 25, 1988

[54] GROOVING AND STAMPING METHOD AND APPARATUS

[75] Inventor: Michael Kubiak, Dover, Del.

[73] Assignee: Metal Masters Foodservice Equipment, Smyrna, Del.

[21] Appl. No.: 79,433

[22] Filed: Jul. 30, 1987

[51] Int. Cl.[4] ..... B21D 15/06; B21D 47/01

[52] U.S. Cl. ..... 72/108; 72/194; 72/478; 101/7; 101/22

[58] Field of Search ..... 72/88, 90, 101, 102, 72/92, 108, 109, 367, 191, 67, 197, 80, 469, 192, 481, 194, 478, 198; 493/270; 101/5-7, 22, 23; 413/55, 73, 76, 78; 10/153; 264/129, 132

[56] References Cited

U.S. PATENT DOCUMENTS

| | | | |
|---|---|---|---|
| 1,480,025 | 1/1924 | Speer | 101/5 |
| 1,709,002 | 4/1929 | Booth | 101/5 |
| 2,357,797 | 9/1944 | Hauer | 101/28 |
| 2,469,426 | 5/1949 | Anthony | 72/107 |
| 3,052,278 | 9/1962 | Baluck et al. | 72/108 |
| 3,350,908 | 11/1967 | Andrews et al. | 72/108 |
| 3,804,006 | 4/1974 | Maquignaz et al. | 72/469 |
| 4,654,912 | 4/1987 | Gray | 72/213 |

FOREIGN PATENT DOCUMENTS

| | | | |
|---|---|---|---|
| 4191 | 2/1975 | Japan | 72/108 |

*Primary Examiner*—Lowell A. Larson

*Attorney, Agent, or Firm*—Connolly and Hutz

[57] ABSTRACT

The method and apparatus described herein produce a tubular shelf post having a plurality of spaced apart annular grooves along the length thereof and stamped indicia on the outside surface of the post at various groove locations. A grooving and stamping roller is utilized to simultaneously groove and stamp the post with indicia, such roller being substantially larger in diameter relative to the post whereby a single roller revolution is sufficient to groove and stamp the post thereby eliminating double stampings.

2 Claims, 5 Drawing Sheets

GROOVING AND STAMPING METHOD AND APPARATUS

BACKGROUND OF THE INVENTION

The present invention relates to the grooving and stamping of tubular shelf posts, and more particularly to providing a post with spaced apart annular grooves along the length thereof and simultaneously stamping indicia on the outside surface of the post at the groove locations.

Adjustable metal shelving is well known, such shelving generally including a planar shelf member and four corner posts. The shelf member has corner supports at each of its corners, and these corner supports are adapted to receive and securely hold the corner posts. The posts are fitted with post supports which hold the corner supports and the posts in a wedging secured arrangement. The posts often include spaced apart annular grooves along the length thereof, the grooves being at fixed distances along the vertical dimension of the post, and the post supports have inwardly directed projections designed to fit into the post grooves. In use, each post support is positioned with the projections thereof in a particular annular groove, each at the same desired vertical height along the post. The corner supports of the shelf member fit over the post supports in wedging engagement therewith to thereby horizontally locate the shelf member at the desired vertical height.

In many cases the annular grooves are spaced about one inch apart along the vertical dimension of the post thereby enabling a great deal of shelf height adjustment. However, with a wide range of available shelf heights, proper shelf location is difficult. With at least four post supports to position, it is often quite difficult to properly position each post support at the same desired vertical height along the post. Time consuming trial and error procedures are necessary to horizontally position the shelf member at a desired location.

SUMMARY OF THE INVENTION

Accordingly, an object of the present invention is the production of shelving posts with spaced apart annular grooves along the length thereof in combination with stamped indicia on the post at various groove locations to facilitate easy assembly of the shelving.

Another object of the present invention is the provision of both apparatus and method for simultaneously grooving and stamping posts, such apparatus and method being easy to use and follow, efficient and highly effective.

In accordance with the present invention, in an apparatus for grooving a tubular post a main framework is provided with a pair of closely spaced drive rollers journaled to such main framework. The axes of the drive rollers are parallel to one another and together define a support surface between the rollers for a tubular post. A motivator is connected to drive each of the rollers in the same direction and thereby rotate a tubular post in an opposite direction. A grooving carriage is movably connected to the main framework, and a grooving roller is journaled to the carriage, the roller having a plurality of spaced apart grooving tools along the length thereof. The axis of the grooving rollers is parallel to the axes of the drive rollers, and the carriage and grooving rollers are shifted toward and away from the drive rollers so that the grooving tools thereon engage a post supported by the drive rollers to thereby groove the posts. The improvement of the present invention is directed to a grooving roller which is substantially larger in diameter than the post being grooved. Also, indicia stamping structure is arranged along the length of the grooving roller, such stamping structure comprising individual dies, one die positioned near each of substantially all of the grooving tools. Appropriate controls are arranged to allow engagement of the grooving tools with a post during approximately one revolution of the grooving roller to thereby eliminate double stamping of a post. Preferably, the stamping structure comprises individual dies substantially serial numbered.

In the process of the present invention, a tubular post is rotatably supoported, and spaced apart annular grooves are machined in the post along the length thereof. The improvement comprises the step of simultaneously stamping indicia next to each of substantially all of the annular grooves to thereby identify each annular groove. Preferably the stamping indicia comprises numbers arranged in a substantially serial manner.

The tubular post of the present invention has a plurality of spaced apart annular grooves on the outer surface thereon arranged along the length of the post. Stamped indicia is provided near each of substantially all of the annular grooves to thereby identify each groove. Preferably the stamped indicia comprises numbers arranged in a substantially serial manner.

BRIEF DESCRIPTION OF THE DRAWINGS

Novel features and advantages of the present invention in addition to those mentioned above will become apparent to those of ordinary skill in the art from a reading of the following detailed description in conjunction with the accompanying drawing wherein similar reference characters refer to similar parts and in which.

DETAILED DESCRIPTION

Figure 1:
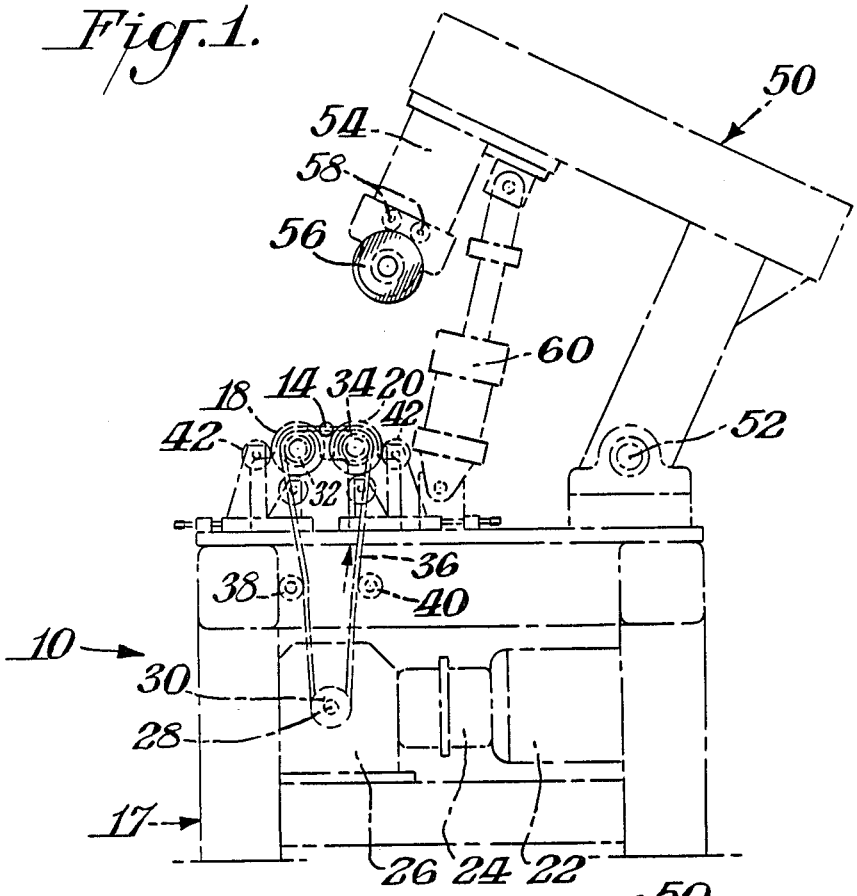
FIG. 1 is an end elevational view of a post grooving and stamping machine in its open post receiving position, according to the present invention.

In accordance with the present invention, a grooving and stamping machine 10 is provided for machining spaced apart annular grooves 12 in a tubular post 14 and simultaneously therewith stamping indicia 16 on the post at various groove locations. As explained elsewhere in this application, the annular grooves facilitate assembly of adjustable metal shelving which in its simplest form includes a planar shelf member and four corner posts. The stamped indicia of the present invention enables shelf assembly in an efficient and highly effective manner by quicky and accurately locating positions on the posts.

Machine 10 includes a main framework 17 which supports a pair of closely spaced drive rollers 18, 20 journaled to the framework. The axes of the drive rollers are parallel to one another and together define a support surface for the tubular post 14. Drive rollers 18, 20 cradle the post therebetween and cause the post to rotate as the rollers rotate.

Figure 2:
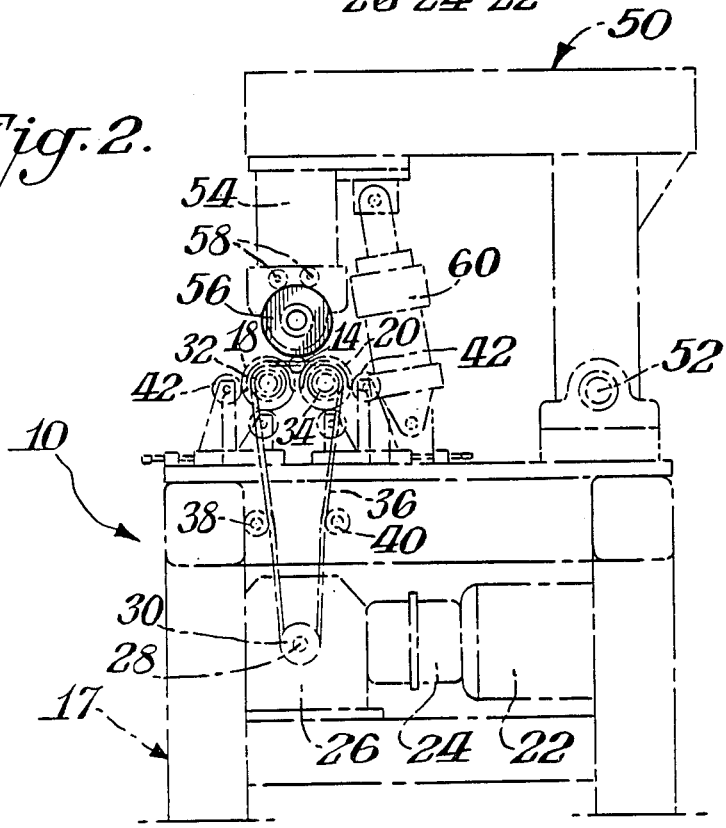
FIG. 2 is an end elevation view similar to FIG. 1 but showing the post grooving and stamping machine in its closed operative position.
Figure 3:
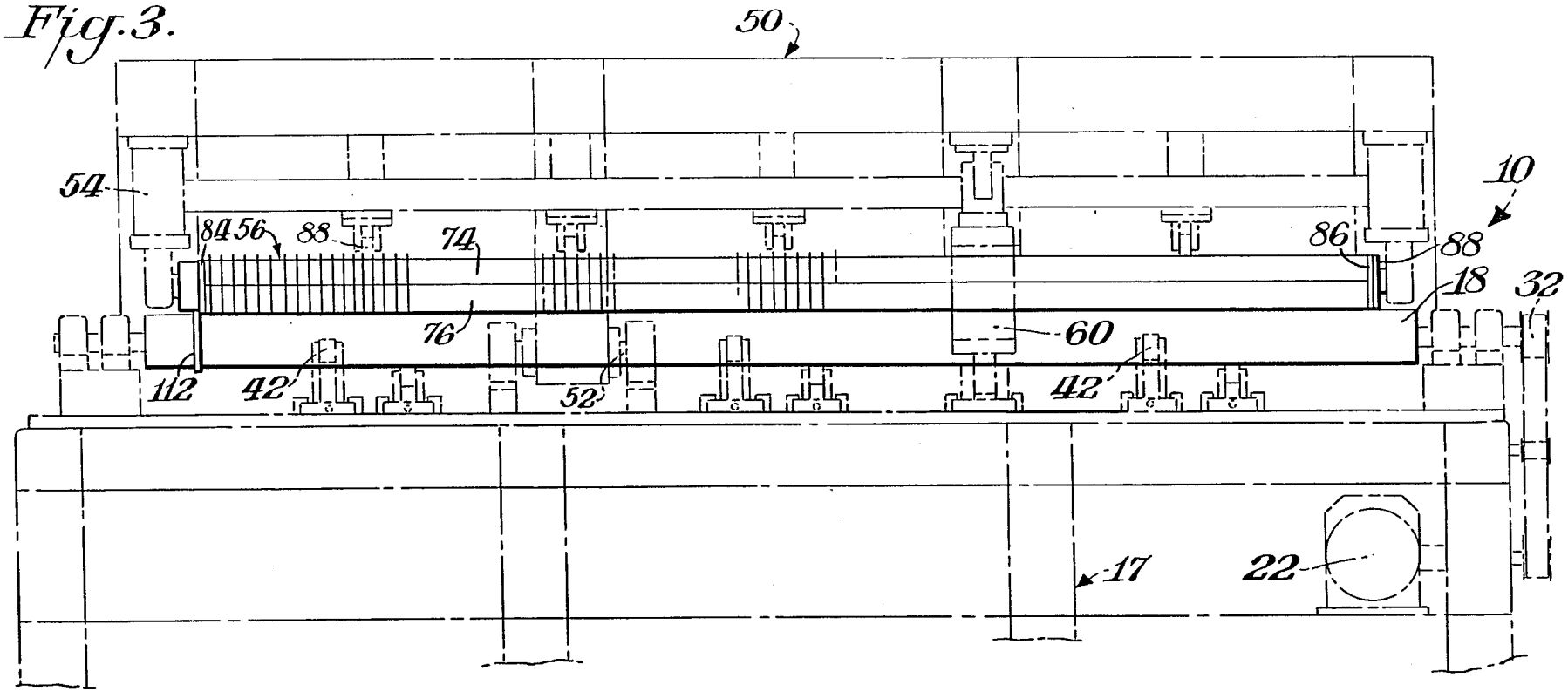
FIG. 3 is a front elevational view of the post grooving and stamping machine shown in FIGS. 1 and 2 with the machine in its operative position as shown in FIG. 2.

As shown best in FIGS. 1 and 2, a motor 22, clutch 24 and gear box 26 drive a rotatable shaft 28 having a sprocket 30 at the end thereof. Drive rollers 18, 20 also include sprockets 32, 34, and a drive chain 36 is trained around each of the sprockets 30, 32, 34 to thereby drive each of the rollers 18, 20 in the same direction. Idler sprockets 38, 40 also engage the chain 36 for directional and tensioning purposes. Drive rollers 18, 20 rotate in the same direction and post 14 being in engagement therewith is caused to rotate in an opposite direction. Deflection adjustment structure 42 is spaced apart along the length of each drive roller 18, 20 for the purpose of supporting the rollers and preventing deflection thereof. Such structure is best shown in FIGS. 1–3.

A carriage 50 is pivotally connected to main framework 17 for movement toward and away from the tubular post supported by drive rollers 18, 20. Carriage 50 is pivotally connected to the main framework by pivot arrangement 52. The outer end of carriage 50 comprises a generally inverted U-shaped frame 54, and a grooving and stamping roller 56 is journaled to that frame at the free end thereof between the extreme opposite legs of the U-shaped frame. Deflection rollers 58 cooperate with the grooving and stamping roller to prevent undue deflection of roller 56 when grooves 12 are machined into tubular post 14 and indicia 16 stamped on the outer surface thereof. A hydraulic piston and cylinder device 60 interconnects main framework 17 and carriage 50. Operation of hydraulic cylinder and piston 60 causes the grooving and stamping roller to move into engagement with tubular post 14 or shift out of contact and away from the post.

Figure 8:
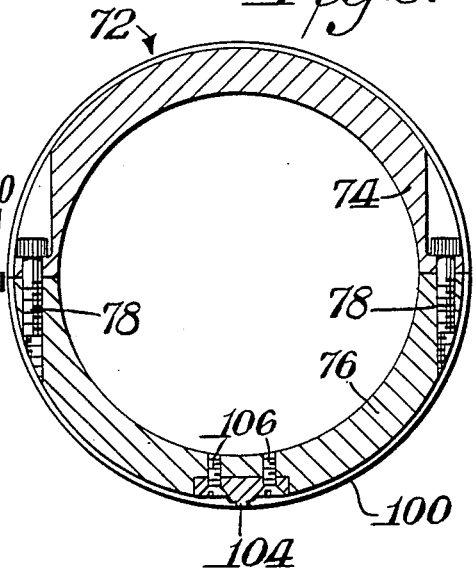
FIG. 8 is a sectional view taken along line 8—8 of FIG. 6.
Figure 9:
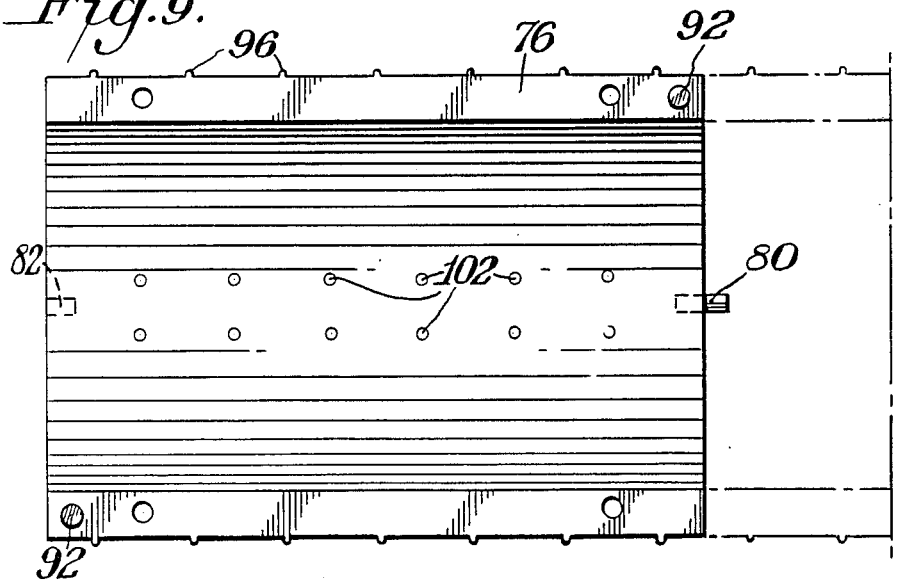
FIG. 9 is a top plan view of the lower half of the two-piece grooving and stamping sleeve shown in FIG. 6.

Grooving and stamping roller 56 generally comprises an internal mandrel 70 with a series of two-piece sleeve assemblies 72 arranged along the length of the mandrel. Each sleeve assembly includes an upper half 74 and a lower half 76 bolted together tightly around mandrel 70 by fasteners 78, as best shown in FIG. 8. Each of the sleeve assemblies 72 abut one another along the mandrel, and appropriate alignment is achieved by pins 80 on one assembly engaging apertures 82 on the next assembly in the line. A forward end plate 84 is positioned on the mandrel, and relative movement between the forward end plate and its adjacent sleeve assembly is prevented by a similar pin and aperture arrangement. Two rear end plates 86, 88 are located at the opposite end of the mandrel. Each end plate has an internally threaded central opening 90, and the end plates are threadably connected to mandrel 70 to assist in securing the sleeve assemblies on the mandrel. Basically, mandrel 70, end plates 84, 86, 88 and two-piece sleeve assemblies 72 form the grooving and stamping roller 56, and these parts rotate as a single unit. Pins 92 and apertures 94 at the innerface between the upper and lower halves 74, 76 of sleeve assembly 72 function to properly maintain alignment of the sleeve halves relative to each other.

A plurality of spaced apart grooving tools 96 are located along the length of each sleeve assembly. As described more fully below, these tools engage the tubular post 14 during the grooving and stamping operation, and they enter the surface of the post to machine the annular grooves 12.

Figure 7:
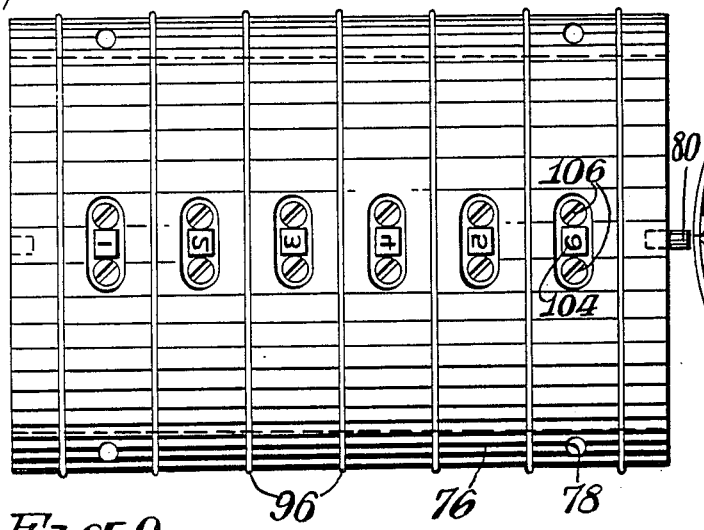
FIG. 7 is a bottom plan view of the two-piece grooving and stamping sleeve shown in FIG. 6.

The bottom half 76 of each sleeve 72 includes a series of spaced apparatus recesses 100 with two threaded openings 102 in the base of each recess. A stamping die 104 is fitted into each recess, and the die is secured to sleeve half 76 by machine screws 106 threaded into openings 102. Each stamping die 104 is located between a pair of adjacent grooving tools 96, and in the embodiment of the invention illustrated in the drawing, six stamping dies are secured to each of six sleeve assemblies. The dies of the first sleeve are serially numbered 1 through 6, as shown best in FIG. 7. Since no die is located between the grooving tools of adjacent sleeve assemblies, the second sleeve assembly includes dies numbering 8 through 13, the third sleeve assembly has dies numbering 15 through 20, and so on.

Figure 4:
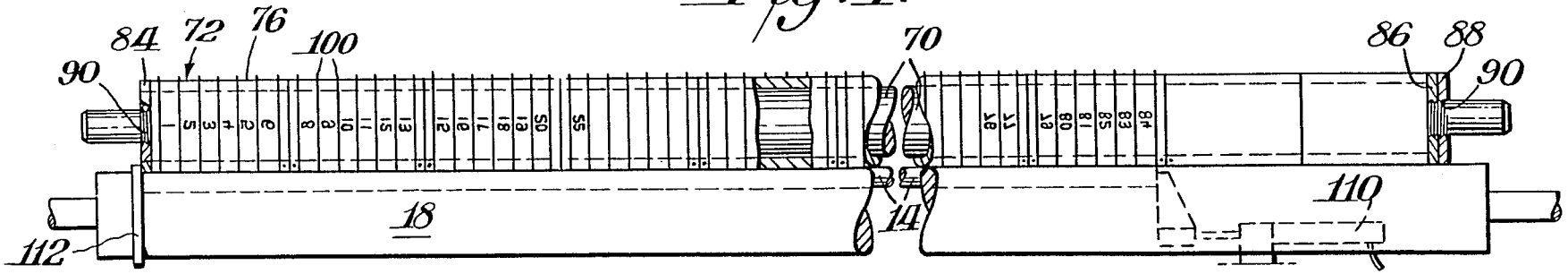
FIG. 4 is a front elevational view of one of the drive rollers of the grooving and stamping machine of FIGS. 1–3 with the grooving and stamping roller thereof in engagement with a tubular post.
Figure 5:
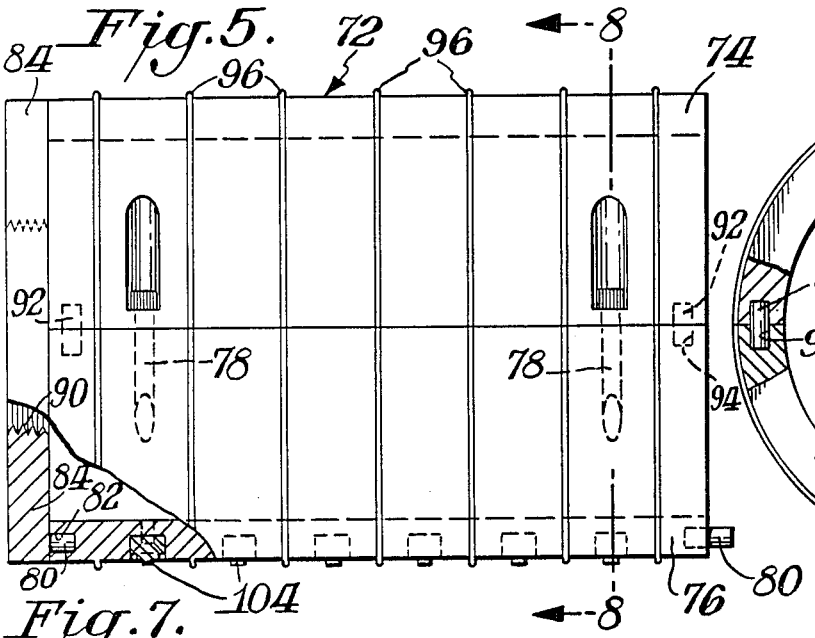
FIG. 5 is a front elevational view of one of the plurality of two-piece grooving and stamping sleeves and an associated end plate, with portions thereof broken away to show interior detail.
Figure 6:
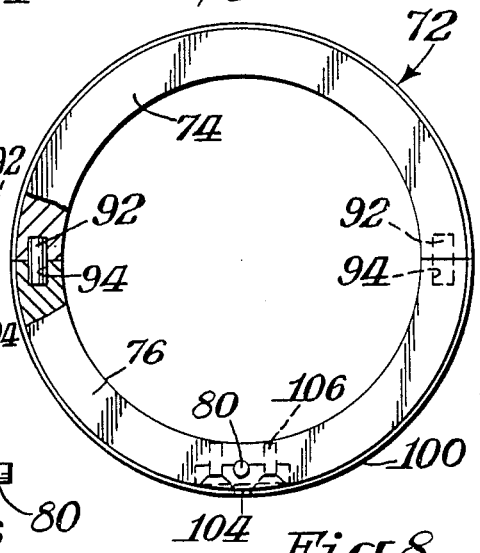
FIG. 6 is a right end elevational view of a two-piece grooving and stamping sleeve shown in FIG. 5.

When a tubular post to be grooved and stamped is placed between the drive rollers 18, 20, a pusher mechanism 110 is energized to urge the post to a forward position against stop collars 112 on the rollers 18, 20 at the forward ends thereof. This mechanism is best shown in FIG. 4, and it assures proper location of each post prior to grooving and stamping.

Figure 10:
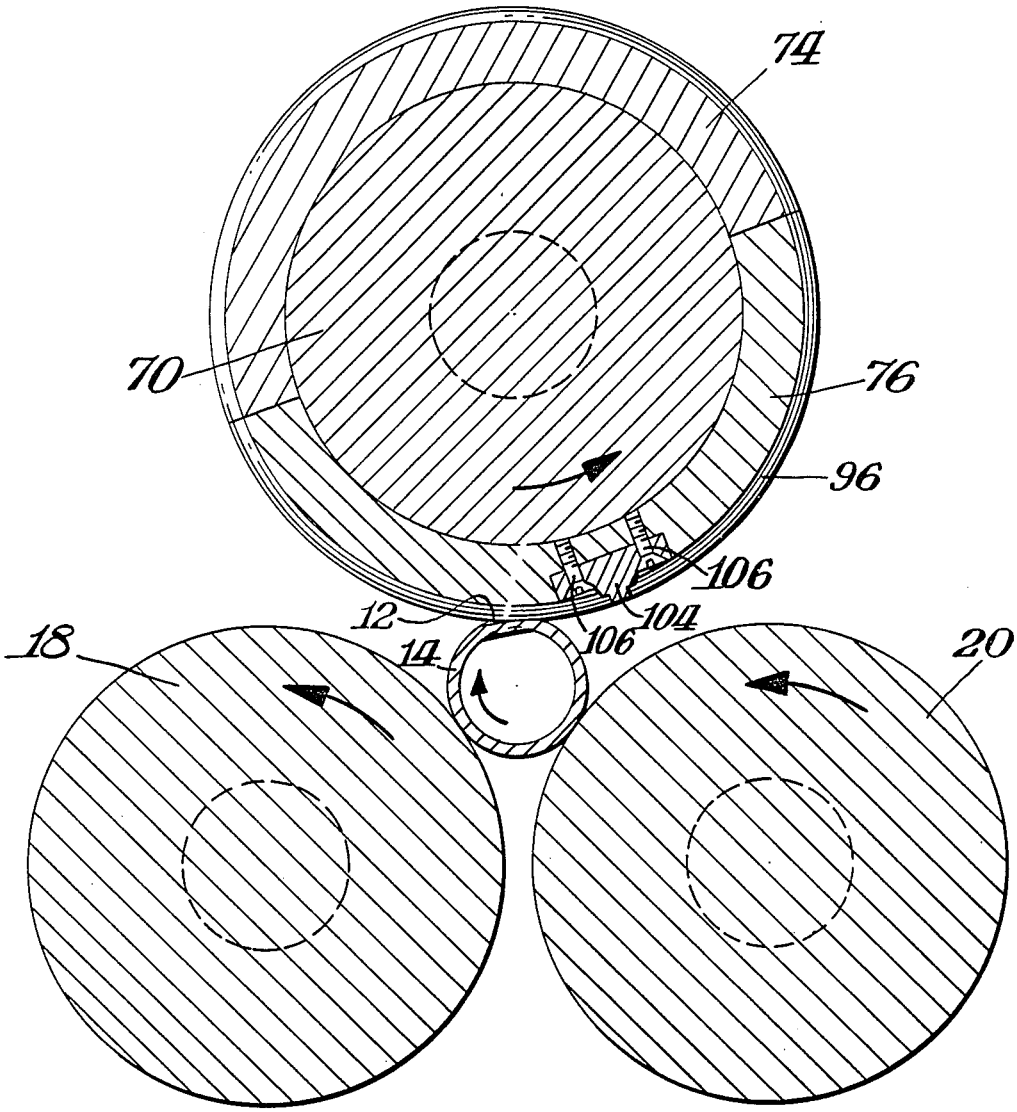
FIG. 10 is an enlarged cross-sectional view illustrating the grooving and stamping roller at the start of its operative cycle in engagement with a tubular post.
Figure 11:
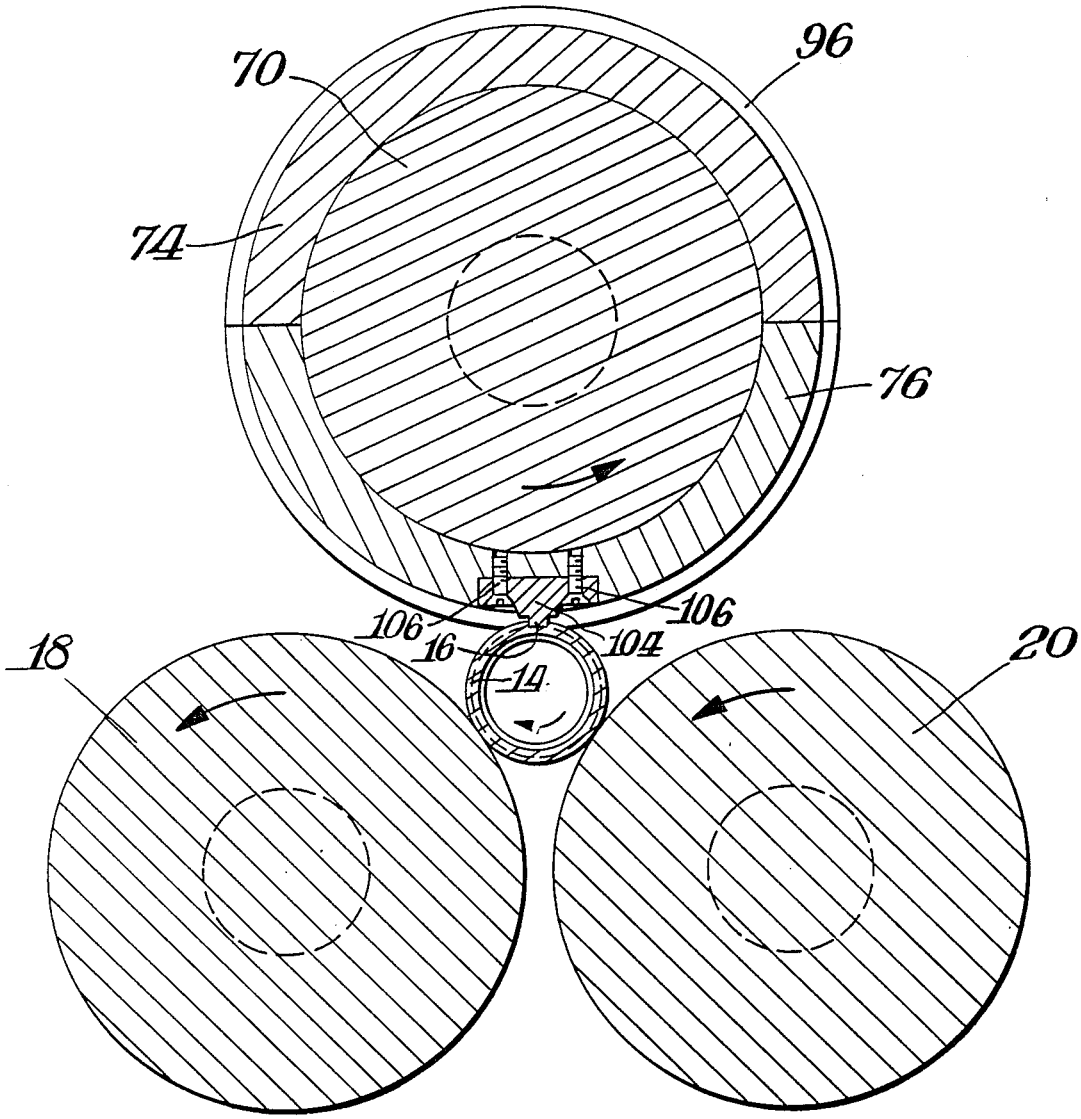
FIG. 11 is an enlarged cross-sectional view similar to FIG. 10 but illustrating the grooving and stamping roller at the end of its operative cycle.
Figure 12:
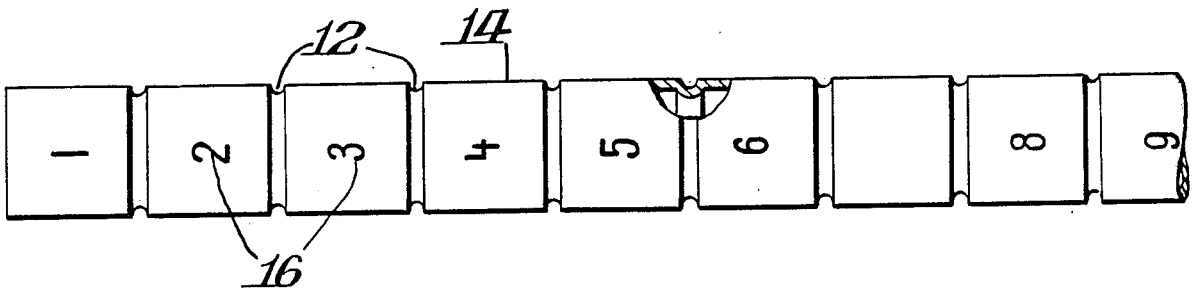
FIG. 12 is an elevational view of a grooved and stamped tubular post, according to the present invention.

In operation, the tubular post 14 is loaded into the machine where it rests between the drive rollers 18, 20. Mechanism 110 urges the post against the stop collars 112 and maintains the post at this relative location throughout the grooving and stamping procedure. As the rollers 18, 20 are caused to rotate, the post being in engagement therewith also rotates but in an opposite direction. Next, the piston and cylinder 60 are energized which causes the grooving and stamping roller 56 to engage the post. FIG. 10 illustrates initial contact of the grooving tools 96 with the tubular post. Continued rotation of the drive rollers causes the post to rotate, and in turn, the post causes the grooving and stamping roller 56 to rotate. Grooving of post 14 continues, and toward the end of the cycle, the stamping dies 104 engage the post to number substantially all of the grooves 12, as shown in FIG. 11. The operative cycle is approximately one revolution of the grooving and stamping roller 56, and the size thereof relative to post 14 assures proper grooving and stamping of the post with no double stampings. The grooving and stamping roller starts and stops at the same position. The carriage 50 is then moved away from drive rollers and the finished product (FIG. 12) is removed from machine 10.

What is claimed is:

1. In an apparatus for grooving a tubular post comprising a main framework, a pair of closely spaced drive rollers journaled to the main framework having axes parallel to one another and together defining a support surface between the rollers for a tubular post, motivator means connected to drive each of the rollers in the same direction and thereby rotate a tubular post in an opposite direction, a grooving carriage movably connected to the main framework, a grooving roller journaled to the grooving carriage having a plurality of spaced apart grooving tools along the length thereof with the axis of the grooving roller parallel to the axes of the drive rollers, means shifting the grooving carriage and the grooving roller toward and away from the drive rollers so that the grooving tools thereon engage a post supported by the drive rollers to thereby groove the post, the improvement according to which the grooving roller is substantially larger in diameter than a post to be grooved, stamping means arranged along the length of the grooving roller comprising individual dies, one die positioned near each of substantially all of the grooving tools, and control means arranged to allow engagement of the grooving tools with a post during approximately one revolution of the grooving roller to thereby eliminate double stamping of the post.

2. The combination of claim 1 wherein the stamping means comprises individual dies substantially serially numbered.

* * * * *